United States Patent [19]

Larson

[11] Patent Number: 4,497,189

[45] Date of Patent: Feb. 5, 1985

[54] DUCT FINISHING MACHINE

[76] Inventor: Kenneth E. Larson, 224 Utah Ave. SE., Huron, S. Dak. 57350

[21] Appl. No.: 477,883

[22] Filed: Mar. 23, 1983

[51] Int. Cl.[3] ..... B21D 39/02; B21D 51/28

[52] U.S. Cl. ..... 72/51; 72/181; 72/214; 29/243.5

[58] Field of Search ..... 72/51, 52, 214, 113, 72/176, 181; 29/243.5, 283.5, 514, 521, 819

[56] References Cited

U.S. PATENT DOCUMENTS 277,180 5/1883 Wilson et al. ..... 29/243.57

4,424,618 1/1984 Stubbings ..... 29/243.5

*Primary Examiner*—E. Michael Combs

*Assistant Examiner*—Charles Rosenberg

[57] ABSTRACT

A duct finishing machine is provided and consists of a duct holding frame that engages and holds a duct in a proper position, a power head carriage that pivotally attaches and locks the duct on the duct holding frame and a power head that moves along the power head carriage traveling an entire length of the duct for sealing a formed lock seam of the duct by rolling a flange down tight.

6 Claims, 5 Drawing Figures

DUCT FINISHING MACHINE

BACKGROUND OF THE INVENTION

The instant invention relates generally to ducts and more specifically it relates to a duct finishing machine.

All buildings built today have duct work in them to carry ventilation and air conditioned air throughout. Metal duct work is made on a machine that puts a machined connector on one edge and a quarter inch flange on the opposite edge to be turned to nest in the machined connector. The flange is now turned over by hammer using either hand, electric or air power creating a lot of noice. This situation is not desirable so accordingly it is eliminated by the invention.

SUMMARY OF THE INVENTION

A principle object of the present invention is to provide a duct finishing machine that will roll down a flange tight.

Another object is to provide a duct finishing machine that is generally quiet.

An additional object is to provide a duct finishing machine that is easy to assemble.

A further object is to provide a duct finishing machine that is economical in cost to manufacture.

A still further object is to provide a duct finishing machine that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DESCRIPTION OF THE PREFERRED EMBODIMENTS

Figure 1:
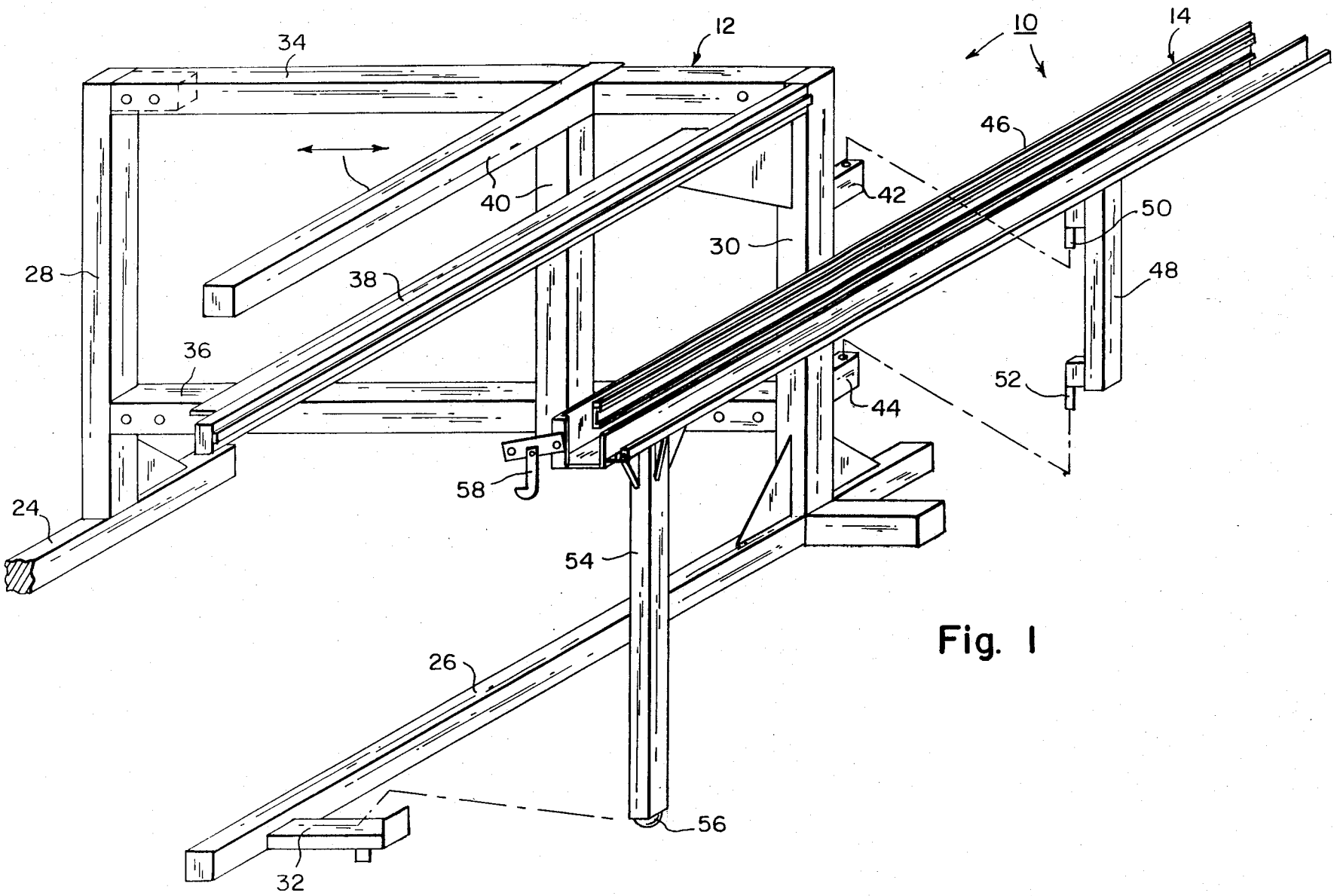
FIG. 1 is a perspective view of the power head carriage and duct holder frame of the invention.
Figure 2:
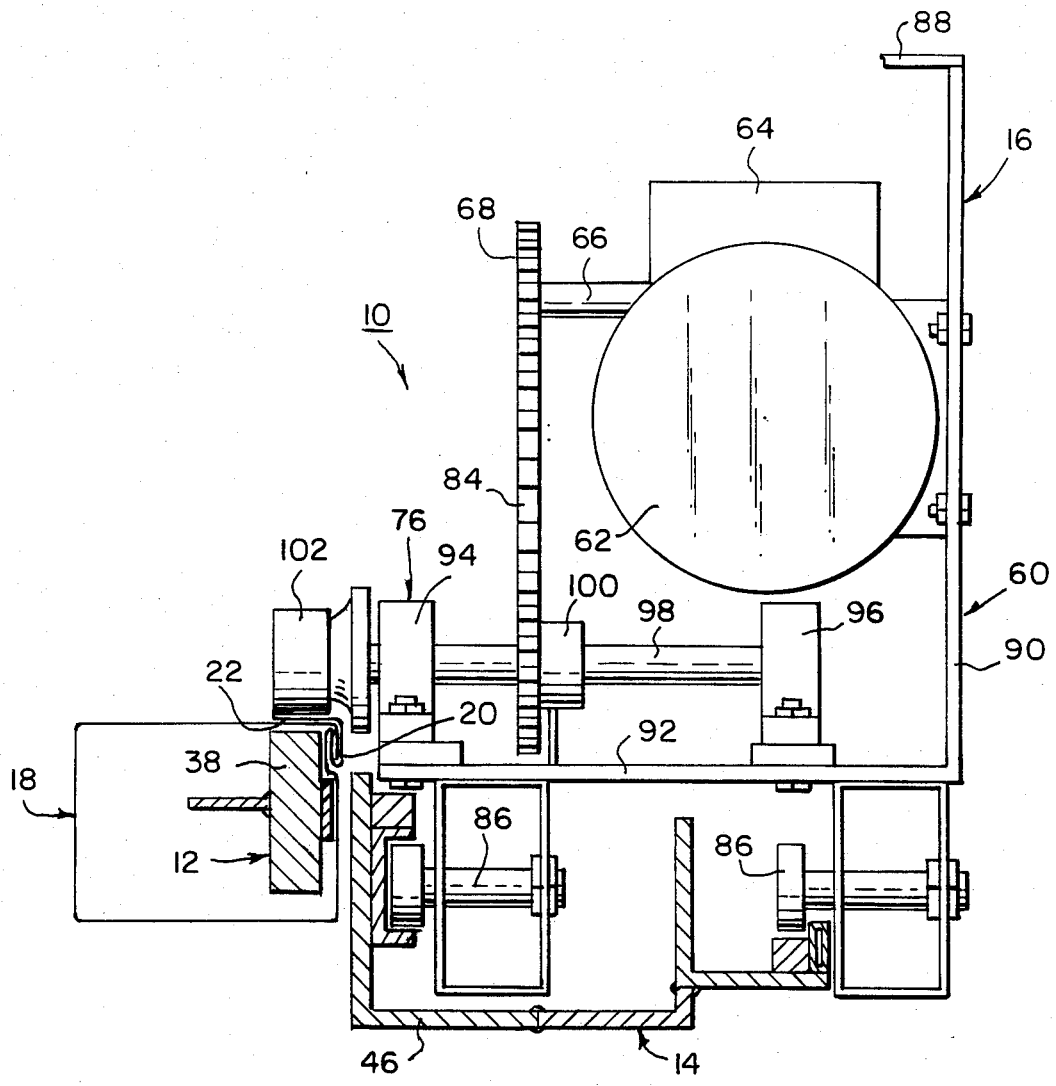
FIG. 2 is an end view of the power head with cover partly in section.
Figure 3:
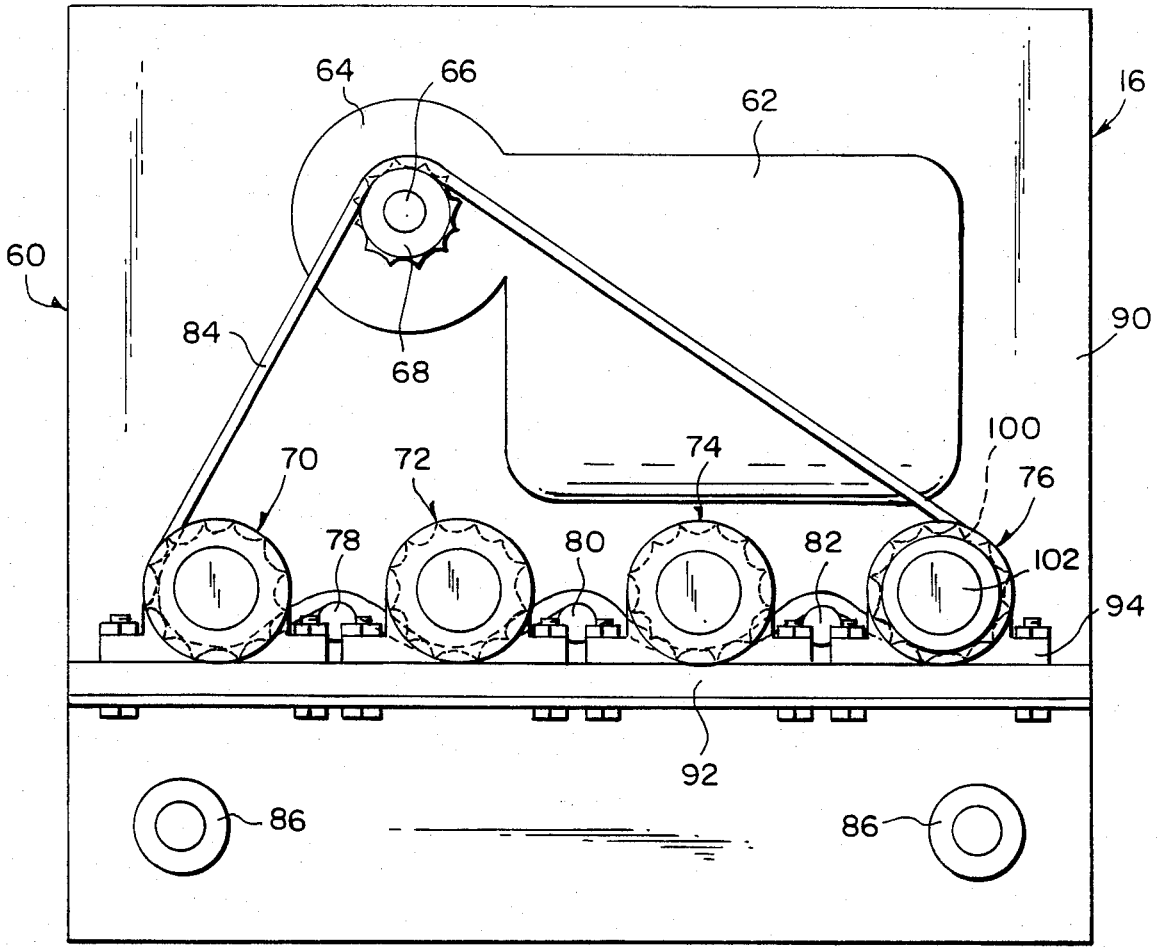
FIG. 3 is a front view of the power head with cover removed.

Turning now descriptively to the drawings, in which similar reference characters denote similar elements throughout the several views, FIGS. 1 through 3 illustrates a duct finishing machine 10. The duct finishing machine 10 consists basically of a duct holding frame 12, a power head carriage 14 and a power head 16.

The duct holding frame 12 engages and holds a duct 18 in a proper position. The power head carriage 14 pivotly attaches and locks the duct 18 on the duct holding frame 12. The power head 16 moves along the power head carriage 14 travelling an entire length of the duct 18 for sealing a formed lock seam 20 of the duct 18 by rolling a flange 22 down tight.

The duct holding frame 12 as shown in FIG. 1 consists of a rear horizontal base member 24, a front horizontal base member 26, a rear vertical leg member 28, a front vertical leg member 30, a horizontal foot member 32, a pair of horizontal frame members 34 and 36, a horizontal duct holding arm member 38, a horizontal duct support arm member 40 and a pair of female hinge portions 42 and 44.

The rear horizontal base member 24 and the front horizontal base member 26 sit on a flat surface such as a floor (not shown). The rear vertical leg member 28 is attached at bottom to right side of the rear horizontal base member 24 and the front vertical leg member 30 is attached at bottom to right side of the front horizontal base member 26. The horizontal foot member 32 is attached at right angle to left side of the front horizontal base member 26.

The pair of horizontal frame members 34 and 36 are attached between the rear vertical leg member 28 and the front vertical leg member 30. The horizontal duct holding arm member 38 is attached at its right side to top of the front vertical leg member 30. The horizontal duct support arm member 40 slidable mates at right angle with the pair of horizontal frame arm members 34 and 36 to compensate for different duct sizes. The pair of female hinge portions 42 and 44 are affixed to the front vertical leg member 30.

The power head carriage 14 as shown in FIG. 1 consists of a horizontal power head carriage member 46, a first vertical leg member 48, a pair of male hinge portions 50 and 52, a second vertical leg member 54, a ball bearing roller 56 and a clamping device 58.

The first vertical leg member 48 is affixed downwardly to right side of the horizontal power head carriage track member 46. The pair of male hinge portions 50 and 52 are affixed to the first vertical leg member 48 to engage with the pair of female hinge portions 42 and 44 that are on the duct holding frame 12. The second vertical leg member 54 is affixed downwardly to left side of the horizontal power head carriage track member 46. The ball bearing roller 56 is affixed to bottom of the second vertical leg member 54 to move along the flat surface and engage with the horizontal foot member 32 on the duct holding frame 12. The clamping device 58 is pivotly affixed to left side of the horizontal power head carriage track member 46 that attaches and locks to left side of the horizontal duct holding arm member 38 of the duct holding frame 12.

The power head 16 as shown in FIGS. 2 and 3 consists of an L-shaped frame 60, a motor 62, reduction gears 64, a shaft 66, a main sprocket 68, four roller die assemblies 70, 72, 74 and 76, three idler wheels, 78, 80 and 82, a continuous chain 84, four ball bearing roller assemblies 86 and a cover 88.

The L-shaped frame 60 has a vertical arm 90 and a horizontal arm 92. The motor 62 is attached to the vertical arm 90 of the frame 60. The reduction gears 64 are driven by the motor 62 and the shaft 66 is connected to the reduction gears 64. The main sprocket 68 is driven by the shaft 66.

The four roller die assemblies 70, 72, 74 and 76 are attached to the horizontal arm 92 of the frame 60. Each idler wheel 78, 80 and 82 are attached to the horizontal arm 92 of the frame 60 between each of the four roller die assemblies 70, 72, 74 and 76. The continuous chain 84 is attached between the main sprocket 68, the four roller die assemblies 70, 72, 74 and 76 and the three idler wheels 78, 80 and 82 to drive the roller die assemblies 70, 72, 74 and 78 that engage the flange 22 of the duct 18. The four ball bearing roller assemblies 86 are attached to bottom of the horizontal arm 92 of the frame 60 and ride in the horizontal power head carriage track 46 of the power head carriage 14. The cover 88 is attached to the horizontal arm 92 and vertical arm 90 of the frame 60.

Each roller die assembly 70, 72, 74 and 76, as best seen in FIG. 2, is comprised of a pair of ball bearing housings 94 and 96, a shaft 98, a sprocket 100 and a roller die 102.

The pair of ball bearing housings 94 and 96 are spaced apart and attached to the horizontal arm 92 of the frame 60. The shaft 98 is rotatably attached to the pair of ball bearing housings 94 and 96 whereby one end of the shaft 98 extends outwardly. The sprocket 100 is attached to the shaft 98 between the pair of ball bearing housings 94 and 96 and engage the chain 84. The roller die 102 is attached to the end of the shaft 98 to engage the flange 22 of the duct 18.

Figure 4:
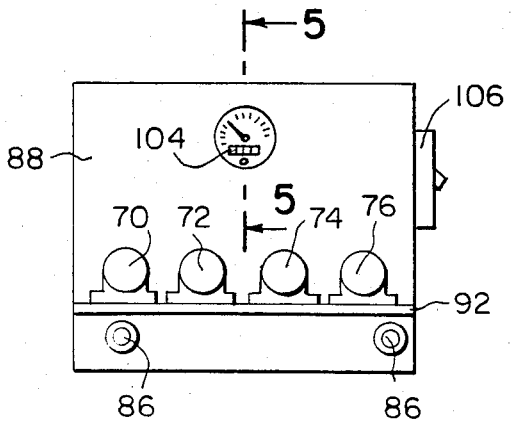
FIG. 4 is a front view of another form of the power head with cover attached.
Figure 5:
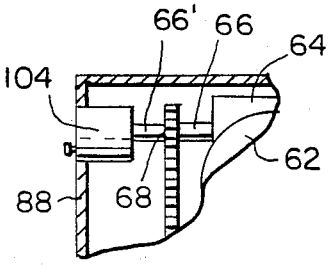
FIG. 5 is a partial cross sectional view taken along line 5—5 in FIG. 4.

FIGS. 4 and 5 show the power head 16 further comprising a odometer 104 attached to an extension 66' of the shaft 66 connected to the reduction gears 64. The odometer is mounted through the cover 88 in front so that a user of the duct finishing machine 10 can measure lengths of ducts. On the side of the cover 88 is a power on-off switch 106 that is mounted for easy access by the user.

The electrical power is transmitted by a flex coil conductor (not shown) which is terminated on the end by a male adapter (not shown) which is plugged into a female receptical (not shown) mounted on the front vertical leg member 30. Also, on the front vertical leg member 30 is a long cord (not shown) rolled up on a cord holder (not shown).

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A duct finishing machine which comprises:

(a) a duct holding frame that engages and holds a duct in a proper position;

(b) a power head carriage that includes means for pivotally attaching and locking the carriage to the duct holding frame; and (c) a power head that moves along the power head carriage travelling an entire length of the duct for sealing a formed lock seam of the duct by rolling a flange down tight.

2. A duct finishing machine as recited in claim 1, wherein the duct holding frame comprises:

(a) a rear horizontal base member that sits on a flat surface;

(b) a front horizontal member that sits on the flat surface;

(c) a rear vertical leg member attached at bottom to right side of the rear horizontal base member;

(d) a front vertical leg member attached at bottom to right side of the front horizontal base member;

(e) a horizontal foot member attached at right angle to left side of the front horizontal base member;

(f) a pair of horizontal frame members attached between the rear vertical leg member and the front vertical leg member;

(g) a horizontal duct holding arm member attached at right side to top of the front vertical leg member;

(h) a horizontal duct support arm member that slideably mates at right angles with the pair of horizontal frame arm members to provide vertical adjustment to accomodate different duct sizes; and (i) a pair of female hinge portions affixed to the front vertical leg member comprising part of said means.

3. A duct finishing machine as recited in claim 2, wherein the power head carriage comprises:

(a) a horizontal power head carriage track member;

(b) a first vertical leg member affixed downwardly to right side of the horizontal power head carriage track member;

(c) a pair of male hinge portions affixed to the first vertical leg member to engage with the said pair of female hinge portions that are on the duct holding frame;

(d) a second vertical leg member affixed downwardly to left side of the horizontal power head carriage track member;

(e) a ball bearing roller affixed to bottom of the second vertical leg member to move along the flat surface and engage with the horizontal foot member on the duct holding frame; and (f) a clamping device pivotly affixed to left side of the horizontal power head carriage track member that attaches and locks to left side of the horizontal duct holding arm member of the duct holding frame.

4. A duct finishing machine as recited in claim 3, wherein the power head comprises:

(a) an L-shaped frame having a vertical arm and a horizontal arm;

(b) a motor attached to vertical arm of the frame;

(c) reduction gears driven by the motor;

(d) a shaft connected to the reduction gears;

(e) a main sprocket driven by the shaft;

(f) a plurality of roller die assemblies, each roller die assembly attached to the horizontal arm of the frame;

(g) a plurality of idler wheels each idler wheel attached to the horizontal arm of the frame between two roller die assemblies;

(h) a continuous chain rotatably attached between the main sprocket, the plurality of roller die assemblies and the plurality of idler wheels to drive the roller die assemblies that engage the flange of the duct;

(i) a plurality of ball bearing roller assemblies attached to bottom of the horizontal arm of the frame that ride in the horizontal power head carriage track of the power head carriage; and (j) a cover attached to the horizontal arm and vertical arm of the frame.

5. A duct finishing machine as recited in claim 4, wherein each roller die assembly comprises:

(a) a pair of ball bearing housings spaced apart and attached to the horizontal arm of the frame;

(b) a shaft rotatably attached to the pair of ball bearing housings whereby one end of the shaft extends outwardly;

(c) a sprocket attached to the shaft between the pair of ball bearing housing that engages the chain; and (d) a roller die attached to the end of the shaft to engage the flange of the duct.

6. A duct finishing machine as recited in claim 5, wherein the power head further comprises an odometer attached to an extension of the shaft connected to the reduction gears with the odometer mounted through the cover in front so that a user of the duct finishing machine can measure lengths of ducts.

* * * * *